US009707430B2

(12) United States Patent
Wu

(10) Patent No.: US 9,707,430 B2
(45) Date of Patent: Jul. 18, 2017

(54) RESISTANCE ADJUSTING APPARATUS

(71) Applicant: Mu-Chuan Wu, Tainan (TW)

(72) Inventor: Mu-Chuan Wu, Tainan (TW)

( * ) Notice: Subject to any disclaimer, the term of this patent is extended or adjusted under 35 U.S.C. 154(b) by 0 days.

(21) Appl. No.: 14/843,370

(22) Filed: Sep. 2, 2015

(65) Prior Publication Data

US 2017/0056700 A1 Mar. 2, 2017

(51) Int. Cl.

| | |
|---|---|
| ***A63B 22/06*** | (2006.01) |
| ***A63B 69/16*** | (2006.01) |
| ***A63B 21/22*** | (2006.01) |
| ***A63B 21/015*** | (2006.01) |

(52) U.S. Cl.

CPC ..... *A63B 21/015* (2013.01); *A63B 22/0605* (2013.01)

(58) Field of Classification Search

CPC ..... A63B 2069/161; A63B 2069/163; A63B 2069/164; A63B 2069/168; A63B 23/0476; A63B 69/16; A63B 21/015; A63B 21/00058; A63B 21/00069; A63B 21/00072; A63B 22/06; A63B 22/0605; A63B 2022/0635; A63B 2022/0658; A63B 2022/0641; A63B 21/012; A63B 21/0125; A63B 2069/162; A63B 2069/165; A63B 2069/166; A63B 2069/167

USPC ..... 482/63, 64

See application file for complete search history.

(56) References Cited

U.S. PATENT DOCUMENTS

| | | | | | |
|---|---|---|---|---|---|
| 5,094,447 | A * | 3/1992 | Wang | A63B 21/0051 | 482/63 |
| 5,145,480 | A * | 9/1992 | Wang | A63B 21/0051 | 482/5 |
| 5,324,242 | A * | 6/1994 | Lo | A63B 21/0051 | 482/63 |
| 6,695,752 | B2 * | 2/2004 | Lee | A63B 21/0051 | 482/110 |
| 8,834,324 | B2 * | 9/2014 | Lull | A63B 21/015 | 482/15 |
| 2002/0193207 | A1 * | 12/2002 | Wang | A63B 21/0051 | 482/63 |
| 2010/0009815 | A1 * | 1/2010 | Chen | A63B 21/00069 | 482/63 |
| 2010/0234185 | A1 * | 9/2010 | Watt | A63B 21/0051 | 482/8 |
| 2014/0013861 | A1 * | 1/2014 | Wu | G01L 3/101 | 73/862.08 |

(Continued)

*Primary Examiner* — Loan H Thanh
*Assistant Examiner* — Nyca T Nguyen
(74) *Attorney, Agent, or Firm* — Birch, Stewart, Kolasch & Birch, LLP

(57) ABSTRACT

A resistance adjusting apparatus has a bracket, a seat pivotally mounted on the bracket, a resistance supplier mounted in the seat, and an adjusting assembly. The adjusting assembly is mounted on the bracket and connected to the seat. The adjusting assembly has a motor, a stick and a sleeve. The motor is mounted on the bracket and has a spindle. The stick is mounted on the spindle of the motor. The stick has an outer threaded portion formed on an outer surface of the stick. The sleeve is mounted on the seat, is connected to and around the stick, and has an inner threaded portion engaging with the outer threaded portion. The motor can control the moving distance of the resistance supplier accurately. The adjustment precision and the sensitivity of the resistance adjusting apparatus are increased.

6 Claims, 5 Drawing Sheets

(56) References Cited

U.S. PATENT DOCUMENTS

2016/0263417 A1* 9/2016 Golesh ..... A63B 21/00076
2016/0310785 A1* 10/2016 Lo ..... A63B 21/005

* cited by examiner

RESISTANCE ADJUSTING APPARATUS

BACKGROUND OF THE INVENTION

1. Field of the Invention

The invention relates to a resistance adjusting apparatus, and more particularly to a resistance adjusting apparatus applied to fitness equipments.

2. Description of Related Art

A conventional resistance adjusting apparatus is mounted on a fitness equipment such as an exercise bike. A resistance of the fitness equipment supplied from the conventional resistance adjusting apparatus can be adjusted according to the training intensity of users. The conventional resistance adjusting apparatus has a seat and an adjusting assembly. The seat is pivotally mounted on a frame of the exercise bike. The adjusting assembly is mounted on the seat and is connected to the frame.

The adjusting assembly has a hollow tube, a regulating rod, a spring, and a resistance supplier. The tube is fixedly mounted in the frame. The regulating rod is mounted through the tube and can be moved upward or downward relative to the tube. The regulating rod has a head, a body, and a barrier. The body is mounted on a bottom surface of the head and extends through the tube. The barrier is mounted around the body and is located in the tube. The spring is mounted around the body. Two ends of the spring are respectively connected to the tube and the barrier. The resistance supplier is mounted on a bottom end of the body and is deposited on the seat.

When the regulating rod is rotated to move downwardly by users, the resistance supplier is moved downward and is connected to a flywheel of the exercise bike for increasing the resistance of the exercise bike. On the contrary, when the regulating rod is rotated to move upwardly by users, the resistance supplier is moved upward for decreasing the resistance of the exercise bike.

However, the conventional resistance adjusting apparatus is adjusted manually, and adjustment precision of the conventional resistance adjusting apparatus is not easy to control. In addition, the body is not easy to be kept in position, so positioning of the resistance supplier is not stable after adjustment. Therefore, the resistance cannot be kept at a constant value after adjustment.

To overcome the shortcomings, the present invention provides a resistance adjusting apparatus to obviate the aforementioned problems.

SUMMARY OF THE INVENTION

An objective of the invention is to provide a resistance adjusting apparatus to improve the adjustment precision of the resistance adjusting apparatus, and improve the positioning of the resistance supplier.

The resistance adjusting apparatus has a bracket, a seat, a resistance supplier and an adjusting assembly. The bracket has a through hole formed through the bracket. The seat is pivotally mounted on the bracket. The resistance supplier is mounted in the seat below the bracket. The adjusting assembly is mounted on the bracket and connected to the seat. The adjusting assembly has a motor, a stick and a sleeve. The motor is mounted on the bracket and has a spindle. The spindle is rotatably mounted on a bottom face of the motor and faces the through hole of the bracket. The stick is mounted on the spindle of the motor and is inserted through the through hole of the bracket. The stick has an outer threaded portion formed on an outer surface of the stick. The sleeve is mounted on the seat, is connected to and around the stick, and has an inner threaded portion. The inner threaded portion is formed on an inner face of the sleeve and engages with the outer threaded portion of the stick.

The stick is driven by the motor via the spindle, and then the stick is rotated to drive the sleeve. The sleeve can be moved upward and downward along the stick. In the meantime, the seat is driven by the sleeve to rotate, and then the resistance supplier driven by the seat is moved. The motor can control the moving distance of the resistance supplier accurately. The positioning of the resistance supplier is stable after adjustment. Adjustment precision and sensitivity of the resistance adjusting apparatus are both increased.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
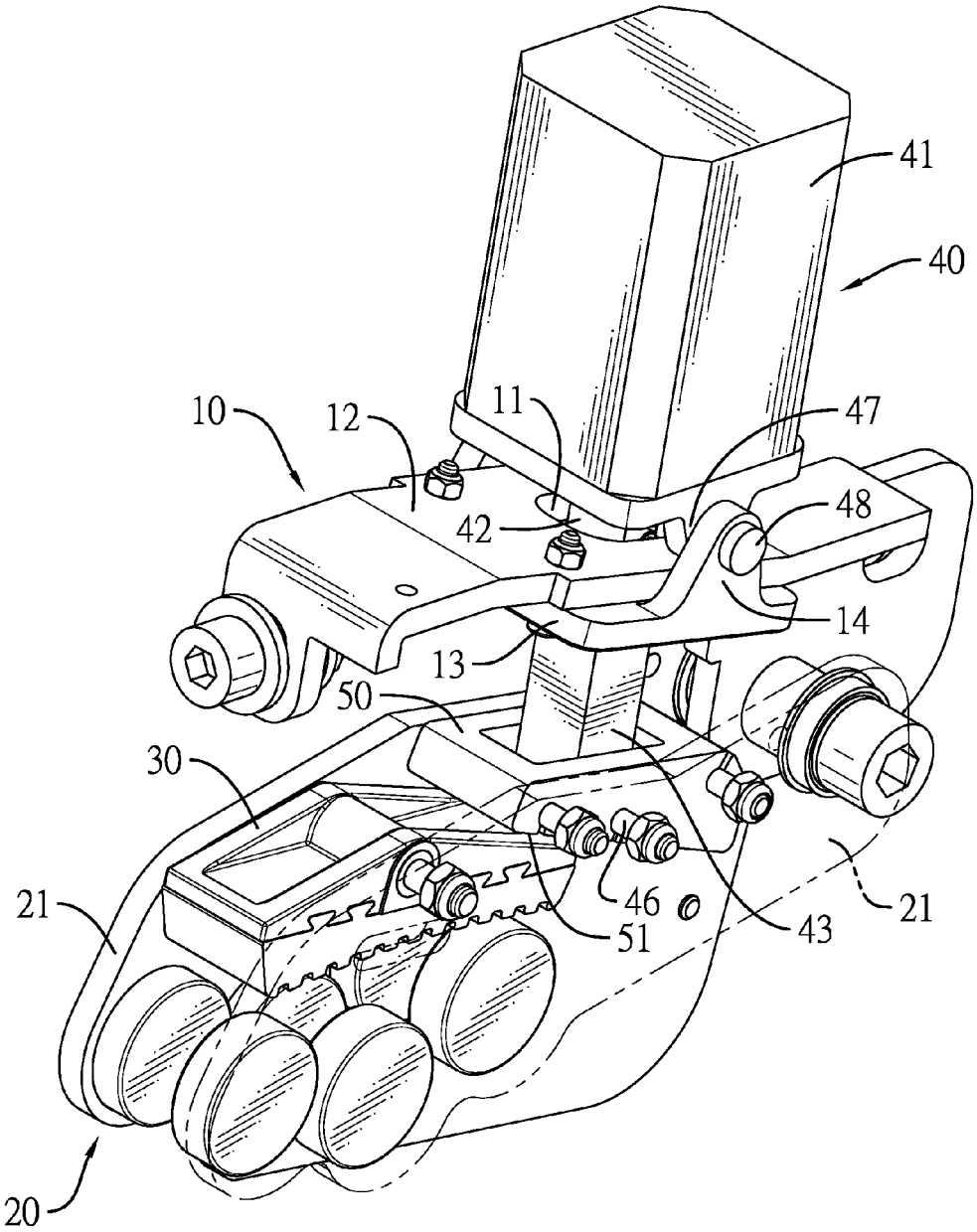
FIG. 1 is a perspective view of a first embodiment of a resistance adjusting apparatus in accordance with the present invention.

With reference to FIG. 1, a first embodiment of a resistance adjusting apparatus in accordance with the present invention comprises a bracket 10, a seat 20, a resistance supplier 30, and an adjusting assembly 40.

The bracket 10 has a through hole 11 formed through the bracket 10. The seat 20 is pivotally connected to the bracket 10. The resistance supplier 30 is mounted in the seat 20 below the bracket 10.

The adjusting assembly 40 is mounted on the bracket 10 and is connected to the seat 20. The adjusting assembly 40 has a motor 41, a stick 42, and a sleeve 43. The motor 41 is mounted on the bracket 10 and has a spindle 411. The spindle 411 is rotatably mounted on a bottom face of the motor 41 and faces the through hole 11 of the bracket 10. The stick 42 is mounted on the spindle 411 of the motor 41 and is inserted through the through hole 11 of the bracket 10. The stick 42 has an outer threaded portion 44 formed on an outer surface of the stick 42. The sleeve 43 is mounted on the seat 20, is connected to and around the stick 42, and has an inner threaded portion 45. The inner threaded portion 45 is formed on an inner face of the sleeve 43 and engages with the outer threaded portion 44 of the stick 42.

Figure 3:
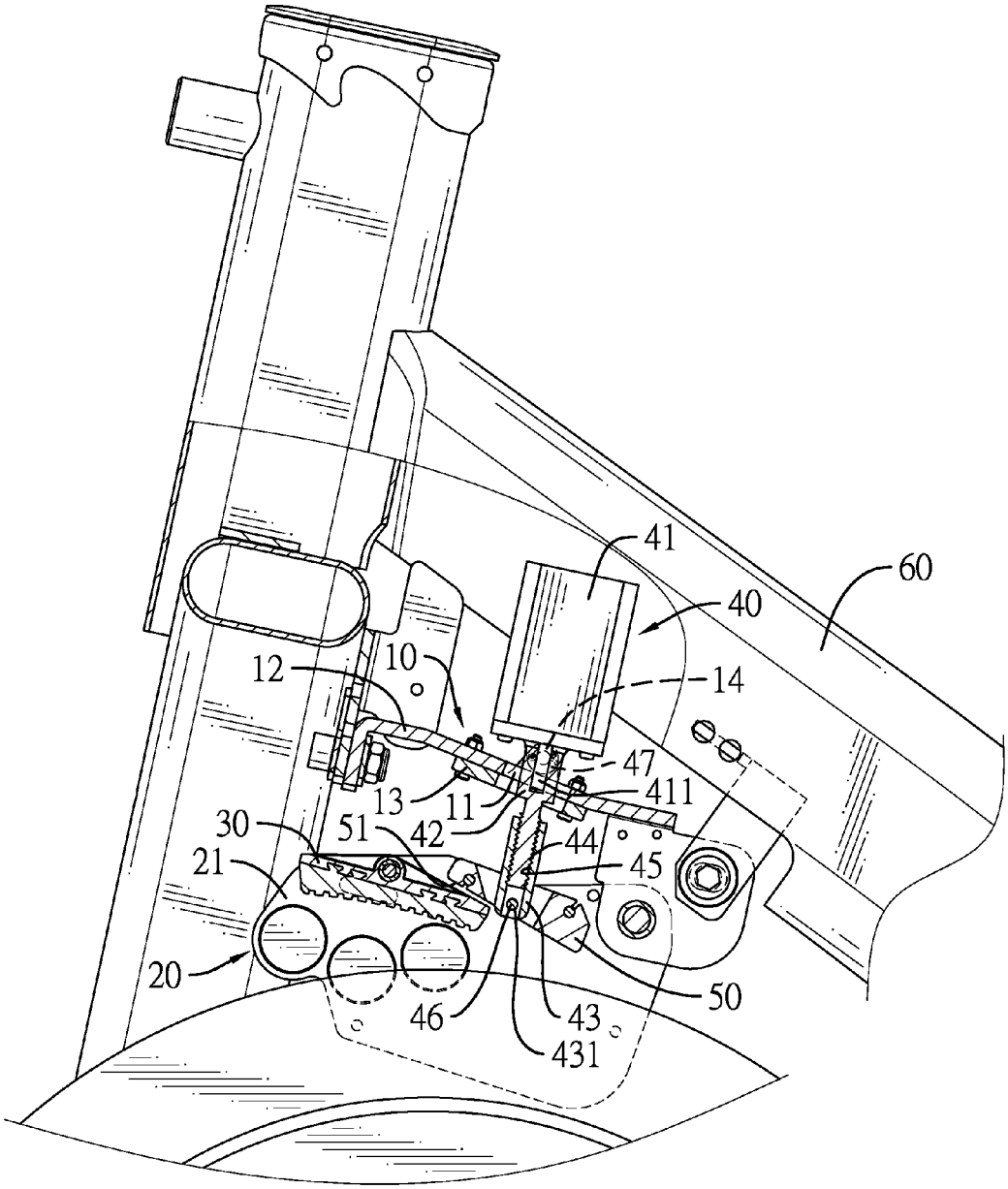
FIG. 3 is an enlarged side view in partial section of the resistance adjusting apparatus in FIG. 2.
Figure 5:
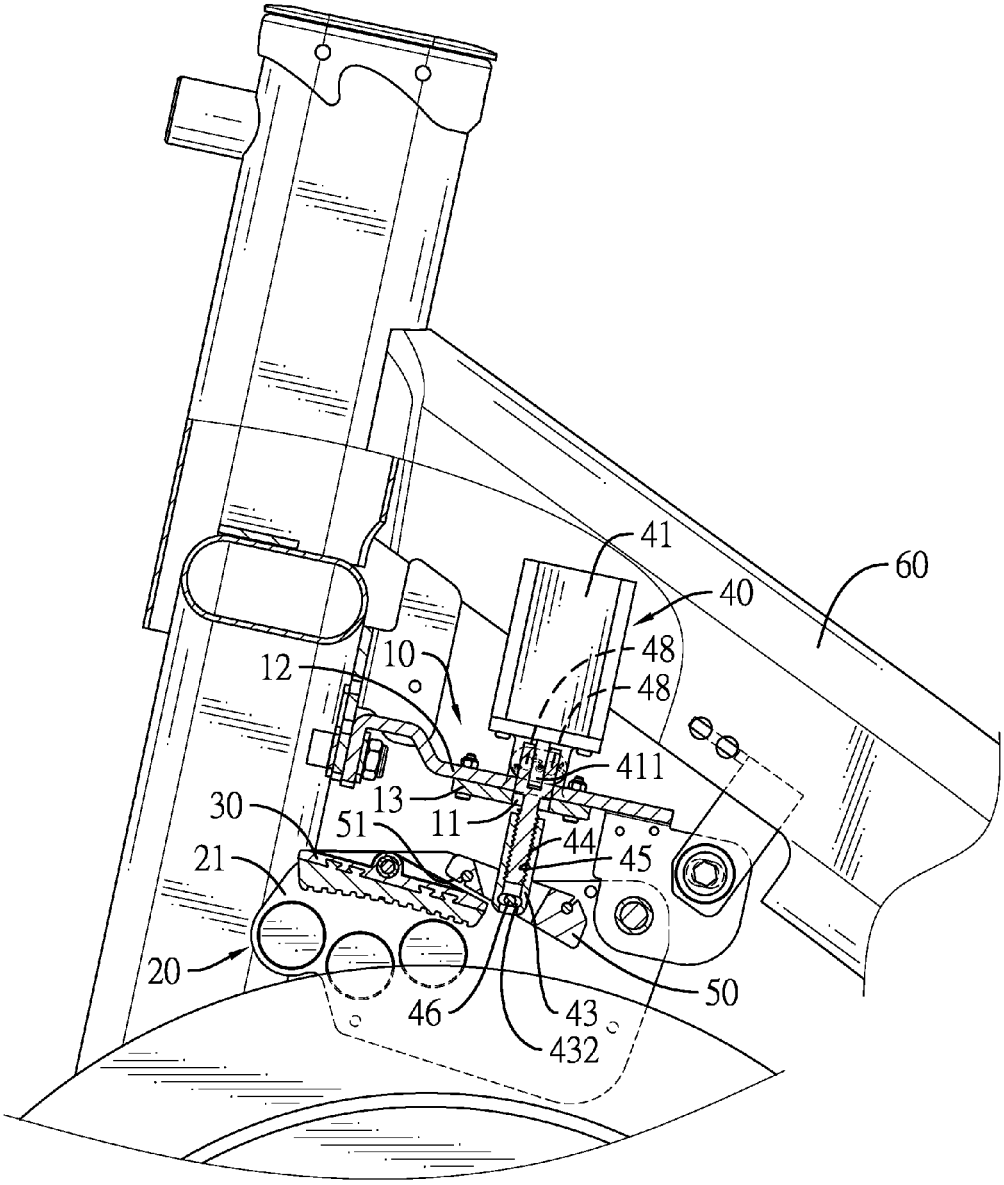
FIG. 5 is a side view in partial section of a second embodiment of a resistance adjusting apparatus in accordance with the present invention, shown mounted on a frame of an exercise bike.

With reference to FIG. 3, the motor 41 is pivotally mounted on the bracket 10, and the sleeve 43 has a circular hole 431 transversally formed through the sleeve 43 adjacent to a lower end of the sleeve 43, and a shaft 46 is inserted through the circular hole 431 of the sleeve 43 and is mounted in the seat 20. With reference to FIG. 5, in a second embodiment of a resistance adjusting apparatus in accordance with the present invention, the motor 41 is fixedly mounted on the bracket 10, the sleeve 43 has an elongated hole 432 transversally formed through the sleeve 43, and a shaft 46 is inserted through the elongated hole 432 of the sleeve 43 and is mounted in the seat 20.

With reference to FIGS. 1 and 3, the resistance adjusting apparatus has a positioning block 50 mounted in the seat 20 around the sleeve 43 and has a positioning surface 51. The positioning surface 51 is formed on the positioning block 50 above the resistance supplier 30 and faces the resistance supplier 30. In addition, the bracket 10 has a first plate 12 and a second plate 13. The first plate 12 is deposited on a top of the bracket 10. The second plate 13 is deposited on a bottom of the bracket 10, is mounted below the first plate 12, and has two first wings 14. The two first wings 14 are formed on and protrude from a top face of the second plate 13 at a spaced interval and extend out of the first plate 12. The motor 41 has two second wings 47. The second wings 47 are mounted on the motor 41 and respectively face the first wings 14. The adjusting assembly 40 has two rods 48. The two rods 48 are respectively inserted through the two first wings 14 and are respectively connected to the two second wings 47.

With reference to FIG. 5, in the second embodiment of a resistance adjusting apparatus in accordance with the present invention, the adjusting assembly 40 has four rods 48, and two of the four rods 48 are inserted through one of the two first wings 14, and the other two of the four rods 48 are inserted through the other one of the two first wings 14. Therefore, each one of the second wings 47 is connected to the two rods 48 on a corresponding one of the first wings 14. In addition, the seat 20 has two side plates 21 mounted at a spaced interval. The resistance supplier 30 and the positioning block 50 are deposited between the two side plates 21 of the seat 20.

Figure 2:
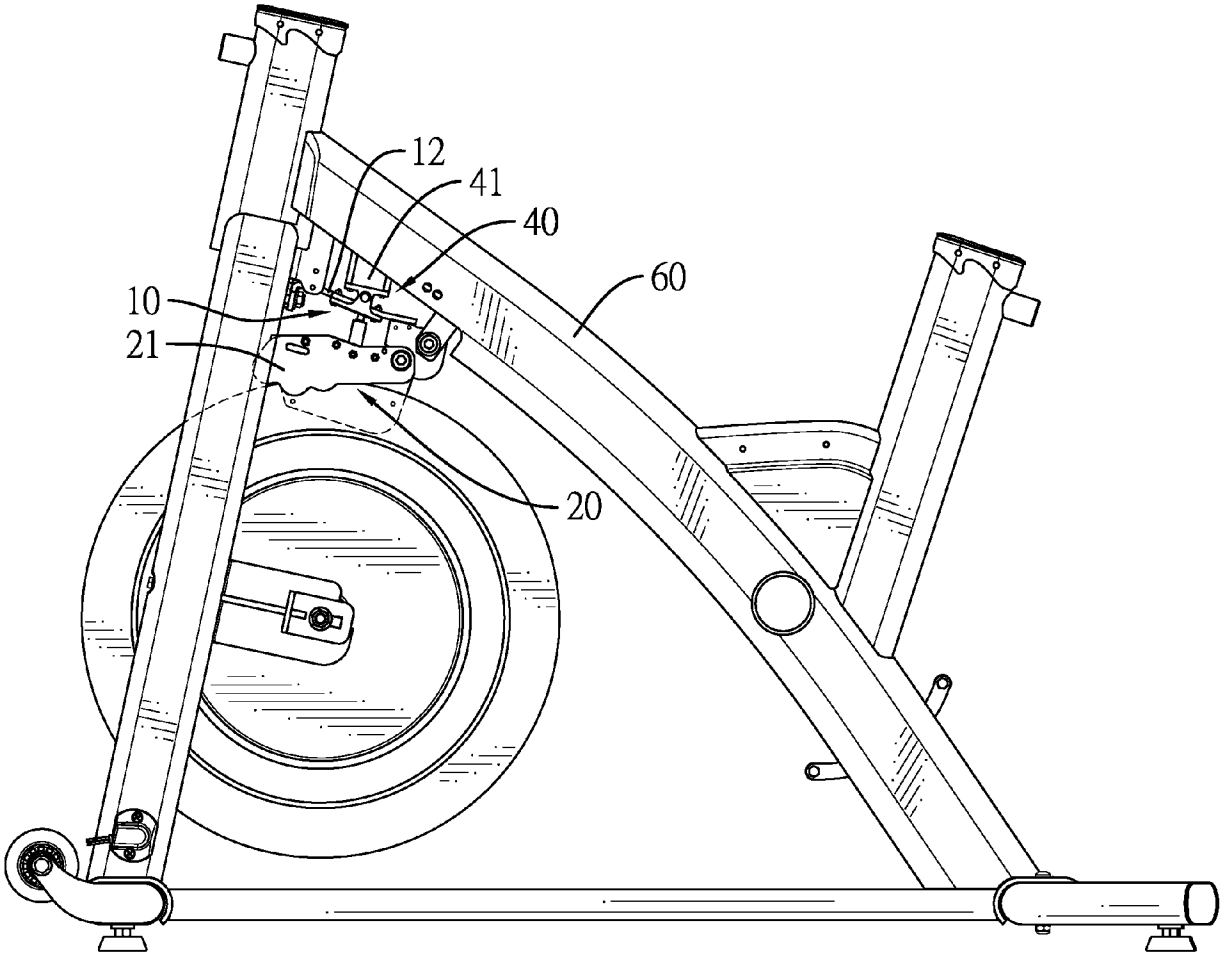
FIG. 2 is an operational side view of the resistance adjusting apparatus in FIG. 1, shown mounted on a frame of an exercise bike.
Figure 4:
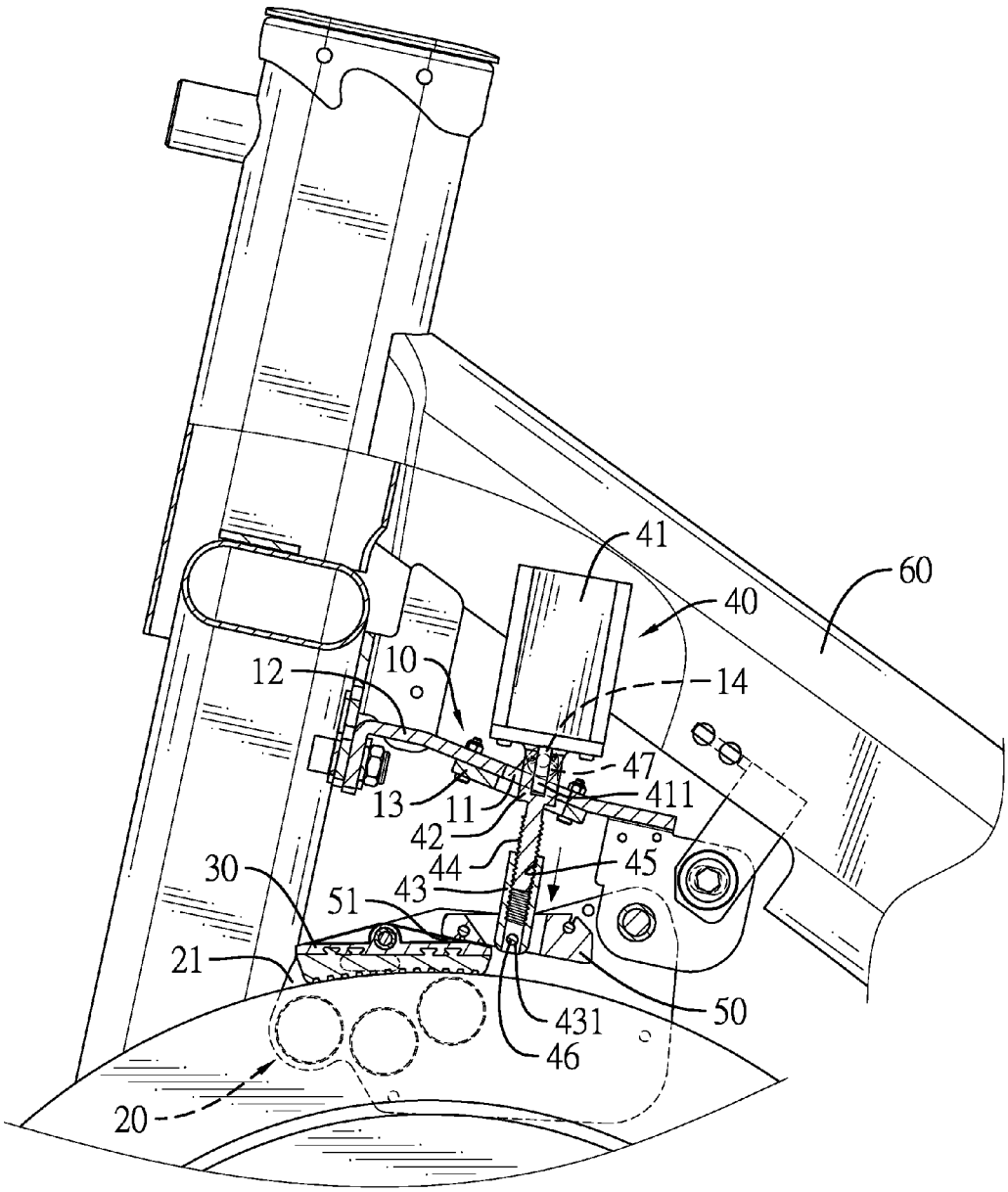
FIG. 4 is another enlarged side view in partial section of the resistance adjusting apparatus in FIG. 2.

With reference to FIGS. 2 and 3, the resistance adjusting apparatus is mounted on a frame 60 of an exercise bike. The first plate 12 of the bracket 10 is fixedly mounted on the frame 60. With reference to FIG. 4, when a user needs to adjust the resistance of the exercise bike, the stick 42 is driven by the spindle 411 of the motor 41. The sleeve 43 driven by the stick 42 is moved upward and downward along the stick 42 and drives the seat 20 to rotate. The resistance supplier 30 is pivoted with the pivot of the seat 20 and generates a displacement. When the resistance supplier 30 is moved downward, the resistance of the exercise bike is increased. When the resistance supplier 30 is moved upward, the resistance of the exercise bike is decreased.

With reference to FIGS. 3 and 4, the motor 41 is pivotally mounted on the bracket 10, and a bottom end of the sleeve 43 is fixed on the seat 20. When the motor 41 drives the seat 20 to pivot, the motor 41 can pivot relative to the bracket 10, and the seat 20 is pushed by the sleeve 43. The resistance supplier 30 is moved with the seat 20 to adjust the resistance of the exercise bike. With reference to FIG. 5, the motor 41 is fixed on the bracket 10, and the sleeve 43 can generate a lateral displacement relative to the seat 20 by the shaft 46 moving along the elongated hole 432. When the motor 41 drives the seat 20 to pivot, the motor 41 cannot pivot relative to the bracket 10. The sleeve 43 can generate a longitudinal displacement and a lateral displacement. The sleeve 43 smoothly pushes the seat 20. Then, the resistance supplier 30 is moved with the seat 20 to adjust the resistance of the exercise bike.

Accordingly, the motor 41 of the resistance adjusting apparatus controls the stick 42 to rotate, the sleeve 43 is moved and drives the seat 20 to pivot, and then the displacement of the resistance supplier 30 is accurately controlled by the motor 41. Furthermore, positioning and sensitivity of the motor 41 are good. Therefore, the positioning of the resistance supplier 30 is stable after adjustment, and adjustment precision of the resistance adjusting apparatus is increased.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A resistance adjusting apparatus comprising:

a bracket having a through hole formed through the bracket;

wherein the bracket has a first plate deposited on a top part of the bracket and a second plate mounted below the first plate and having two first wings formed on and protruding from a top face of the second plate and extending out of the first plate:

a seat pivotally mounted on the bracket;

a resistance supplier mounted in the seat below the bracket; and an adjusting assembly mounted on the bracket and connected to the seat, and the adjusting assembly having a motor fixedly mounted on the bracket and having a spindle, the spindle rotatably mounted on a bottom face of the motor and facing the through hole of the bracket;

a stick mounted on the spindle of the motor and inserted through the through hole of the bracket, and the stick having an outer threaded portion formed on an outer surface of the stick; and a sleeve mounted on the seat, connected to and around the stick, and having an inner threaded portion and an elongated hole, the inner threaded portion formed on an inner face of the sleeve and engaging with the outer threaded portion of the stick, and the elongated hole being transversally formed through the sleeve; and a shaft inserted through the elongated hole of the sleeve and mounted in the seat.

2. The resistance adjusting apparatus as claimed in claim 1, wherein the resistance adjusting apparatus has a positioning block mounted in the seat around the sleeve, and having a positioning surface formed on the positioning block above the resistance supplier and facing the resistance supplier.

3. The resistance adjusting apparatus as claimed in claim 2, wherein the motor has two second wings mounted on the motor and respectively facing the first wings;

the adjusting assembly has four rods, and two of the four rods inserted through one of the two first wings and the other two of the four rods inserted through the other one of the two first wings.

4. The resistance adjusting apparatus as claimed in claim 3, wherein the seat has two side plates mounted at a spaced interval, and the resistance supplier is deposited between the two side plates of the seat.

5. The resistance adjusting apparatus as claimed in claim 1, wherein the motor has two second wings mounted on the motor and respectively facing the first wings; and the adjusting assembly has two rods respectively and transversally inserted through the two first wings and respectively connected to the two second wings.

6. The resistance adjusting apparatus as claimed in claim 1, wherein the seat has two side plates mounted at a spaced interval, and the resistance supplier is deposited between the two side plates of the seat.

* * * * *